US008143207B2

(12) United States Patent
Mayer et al.

(10) Patent No.: US 8,143,207 B2
(45) Date of Patent: Mar. 27, 2012

(54) BIOCIDAL TEXTILE TREATMENT AGENT

(75) Inventors: Konstanze Mayer, Düsseldorf (DE); Karl-Heinz Scheffler, Düsseldorf (DE); Dietmar Schröter, Düsseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/783,841

(22) Filed: May 20, 2010

(65) Prior Publication Data

US 2010/0227790 A1 Sep. 9, 2010

Related U.S. Application Data

(63) Continuation of application No. PCT/EP2008/065741, filed on Nov. 18, 2008.

(30) Foreign Application Priority Data

Nov. 23, 2007 (DE) ..... 10 2007 056 936

(51) Int. Cl.
*C11D 1/835* (2006.01)

(52) U.S. Cl. ..... 510/319; 510/514

(58) Field of Classification Search ..... 510/319, 510/504

See application file for complete search history.

(56) References Cited

U.S. PATENT DOCUMENTS

| | | | | |
|---|---|---|---|---|
| 6,593,287 | B1 * | 7/2003 | Jordan et al. | 510/475 |
| 6,844,309 | B1 * | 1/2005 | Sivik et al. | 510/475 |
| 2002/0189635 | A1 * | 12/2002 | Bodet et al. | 134/1 |

FOREIGN PATENT DOCUMENTS

| | | | |
|---|---|---|---|
| WO | 9520033 | A1 | 7/1995 |
| WO | 9927050 | A1 | 6/1999 |
| WO | 0102522 | A2 | 1/2001 |
| WO | 0146360 | A1 | 6/2001 |
| WO | 2004038084 | A2 | 5/2004 |

OTHER PUBLICATIONS

NEODOL 91-8 Primary Alcohol Ethoxylate. Shell Chemicals, pp. 1-2.

International Cosmetic Ingredient Dictionary and Handbook. The Cosmetic, Toiletry, and Fragrance Association, 7th edition, (1997).

* cited by examiner

*Primary Examiner* — John Hardee
(74) *Attorney, Agent, or Firm* — David P. LeCroy

(57) ABSTRACT

Textile treatment agent containing a biocidal compound, a perfume composition and a non-ionic surfactant, wherein the non-ionic surfactant has an HLB value of from 10.5 to 15 and a cloud temperature of at least 50° C. This allows production of a stable textile treatment agent which reduces the number of microorganisms on textiles treated with the agent and gives the textiles a pleasant fragrance.

12 Claims, No Drawings

BIOCIDAL TEXTILE TREATMENT AGENT

CROSS REFERENCE TO RELATED APPLICATIONS

The present application is a continuation of International Application No. PCT/EP2008/065741 filed 18 Nov. 2008, which claims priority to German Patent Application No. 10 2007 056 936.1 filed 23 Nov. 2007.

The invention relates to a textile treatment agent containing a biocidal compound (biocide), a perfume composition and a non-ionic surfactant, wherein the non-ionic surfactant has an HLB value of from 10.5 to 15 and a cloud temperature of at least about 50° C. The invention also relates to the use of the textile treatment agent and to a method for the production thereof.

Adhesion of microorganisms to surfaces is undesirable, particularly when the microorganisms are pathogenic. Adhering microorganisms frequently lead to infections or reinfection in humans, animals and plants.

Delicate textiles such as silk or microfibers are increasingly being processed into clothing which can only be washed at cooler temperatures of 30 to 40° C. As a result, fungi such as the human pathogen *Candida albicans* are not killed.

In addition to a lower washing temperature, it is also common today to use liquid detergents which are generally free of bleaching agents. In a 60° C. wash as was previously common, almost all microbes were reliably destroyed by either the higher temperature or the bleaching agents contained in conventional detergents used.

Thus, as a result of changing washing behavior, textiles contaminated with viruses, bacteria, molds or yeasts cannot be rendered microbe-free to the required extent and so (re) infection may possibly take place on renewed contact of the consumer with the supposedly clean laundry.

Anti-microbially active compositions and their use in washing or cleaning agents are known in the prior art. These are, for example, textile treatment agents containing one or more biocidal agents and are added to the rinse cycle.

The biocidal compounds used or their commercially available presentations often give off a pungent odor, which is negatively perceived by consumers in both the product and in textiles treated therewith. Simply adding a perfume composition to mask the odor leads to unstable products, particularly at low storage temperatures.

The present invention therefore provides a stable textile treatment agent containing a biocidal compound and a perfume composition as a solution to this problem.

This is achieved by a biocidal textile treatment agent containing a biocidal compound, a perfume composition and a non-ionic surfactant, wherein the non-ionic surfactant has an HLB value of from 10.5 to 15 and a cloud temperature of at least about 50° C.

Surprisingly, it has now been shown that addition of a non-ionic surfactant having a specific HLB value and a specific cloud temperature can effectively stabilize a textile treatment agent containing a biocidal compound and a perfume composition. It has been demonstrated that stabilization does not occur if the non-ionic surfactant exhibits only one of the two properties.

Preferably the non-ionic surfactant has an HLB value of from 11 to 14, and more preferably from 11 to 13.

Non-ionic surfactants with an HLB value in this range and a cloud temperature of at least about 50° C. stabilize textile treatment agents with a biocidal compound and a perfume composition particularly effectively.

It is particularly preferred for the non-ionic surfactant to be an alkoxylated fatty alcohol. Most preferably the non-ionic surfactant is an ethoxylated and/or propoxylated $C_{12}$-$C_{18}$ fatty alcohol.

Alkoxylated fatty alcohols can not only stabilize the textile treatment agent that encompasses a biocidal compound and a perfume composition particularly effectively, but they are widely commercially available and therefore also inexpensive in many cases.

It is preferred for the ratio of non-ionic surfactant to perfume to be greater than or equal to 5:1. It is more preferred for the ratio of non-ionic surfactant to perfume to be greater than 6:1, more preferably between 15:1 and 8:1 and still more preferably between 12:1 and 9:1.

Particularly advantageous textile treatment agents are obtained if the ratio of non-ionic surfactant to perfume composition is within a specific range. The textile treatment agents obtained are sufficiently stable but do not exhibit unfavorable foaming behavior.

It is also advantageous for the textile treatment agent to be chosen from softeners, wash aids and post-treatment agents.

When the textile treatment agent is a softener, it preferably contains a softening component.

It is most particularly preferred for the softening component to be an alkylated, quaternary ammonium compound, wherein at least one alkyl chain is interrupted by an ester or amido group.

Softeners and post-treatment agents are preferred as textile treatment agents since they only come into contact with the textiles in the final stage of a conventional textile washing operation (i.e., the rinse cycle).

Preferably the biocidal compound is chosen from amines, quaternary ammonium compounds, aldehydes, antimicrobial acids and salts thereof, carboxylic acid esters, acid amides, phenols, phenol derivatives, diphenyls, diphenylalkanes, urea derivatives, oxygen acetals, oxygen formals, nitrogen acetals, nitrogen formals, benzamidines, isothiazolines, phthalimide derivatives, pyridine derivatives, guanidines, quinolines and mixtures thereof.

These biocidal compounds act effectively against viruses, bacteria, moulds or yeasts.

In another embodiment, the textile treatment agent additionally contains 0.5 to 5, preferably 1 to 2.5 wt. % ethanol and/or isopropanol.

Ethanol and isopropanol possess antimicrobial action and thus extend the spectrum of action of the textile treatment agent. In addition, they also act as emulsifiers for the perfume and support the non-ionic surfactant in stabilizing the textile treatment agent.

The invention also relates to use of the textile treatment agent according to the invention to reduce the number of microorganisms on textile fabrics treated therewith.

The invention also relates to use of the textile treatment agent according to the invention to reduce the number of microorganisms in a washing or rinsing solution.

Furthermore, the invention also relates to use of a non-ionic surfactant with an HLB value of from 10.5 to 15 and a cloud temperature of at least about 50° C. to stabilize a textile treatment agent containing a biocidal compound and a perfume composition.

The invention also relates to use of a non-ionic surfactant with an HLB value of from 10.5 to 15 and a cloud temperature of at least about 50° C. for stabilizing a textile treatment agent containing a biocidal compound and a perfume composition during storage of the textile treatment agent at 0 to 10° C.

The invention also relates to a method for production of a textile treatment agent comprising a biocidal compound and a perfume composition, wherein a non-ionic surfactant with an HLB value of from 10.5 to 15 and a cloud temperature of at least about 50° C. is added. Textile treatment agents according to the invention are described in detail below, inter alfa, on the basis of examples.

These textile treatment agents include a biocidal compound, a perfume composition and a non-ionic surfactant with an HLB value of from 10.5 to 15 and a cloud temperature of at least about 50° C.

Biocidal compounds in the context of this application refer to those compounds possessing an antimicrobial action and able to reduce the number of microorganisms on textile fabrics treated therewith as well as in the rinsing solution.

Depending on the antimicrobial spectrum and mechanism of action, biocidal compounds are differentiated into bacteriostats and bactericides, fungistats and fungicides, etc. Suitable biocidal compounds are preferably chosen from amines, quaternary ammonium compounds, aldehydes, antimicrobial acids or salts thereof, carboxylic acid esters, acid amides, phenols, phenol derivatives, diphenyls, diphenylalkanes, urea derivatives, oxygen acetals, oxygen formals, nitrogen acetals, nitrogen formals, benzamidines, isothiazolines, phthalimide derivatives, pyridine derivatives, guanidines, quinolines, 1,2-dibromo-2,4-dicyanobutane, iodo-2-propylbutyl carbamate, iodine, iodophores, halogen compounds and any mixtures of the above.

Biocidal compounds here include undecylenic acid, salicylic acid, dihydroacetic acid, o-phenylphenol, N-methylmorpholinoacetonitrile (MMA), 2-benzyl-4-chlorophenol, 2,2'-methylenebis(6-bromo-4-chlorophenol), 4,4'-dichloro-2'-hydroxydiphenyl ether (diclosan), 2,4,4'-trichloro-2'-hydroxydiphenyl ether (triclosan), chlorhexidine, N-(4-chlorophenyl)-N-(3,4-dichlorophenyl)urea, N,N'-(1,10-decanediyldi-1-pyridinyl-4-ylidene)-bis(1-octanamine) dihydrochloride, N,N'-bis(4-chlorophenyl)-3,12-diimino-2,4,11,13-tetraazatetradecanediimidamide, glucoprotamines, guanidines including the bi- and polyguanidines, such as e.g. 1,6-bis(2-ethylhexylbiguanidohexane)dihydrochloride, 1,6-di-($N_1$,$N_1$'-phenyldiguanido-$N_5$,$N_5$')hexane tetrahydrochloride, 1,6-di-($N_1$,$N_1$'-phenyl-$N_1$,$N_1$-methyldiguanido-$N_5$,$N_5$') hexane dihydrochloride, 1,6-di-($N_1$,$N_1$'-o-chlorophenyldiguanido-$N_5$,$N_5$')hexane dihydrochloride, 1,6-di($N_1$,$N_1$'-2,6-dichlorophenyldiguanido-$N_5$,$N_5$')hexane dihydrochloride, 1,6-di-[$N_1$,$N_1$'-beta-(p-methoxyphenyl) diguanido-$N_5$,$N_5$']hexane dihydrochloride, 1,6-di-($N_1$,$N_1$'-alpha-methyl-beta.-phenyldiguanido-$N_5$,$N_5$')hexane dihydrochloride, 1,6-di-($N_1$,$N_1$'-p-nitrophenyldiguanido-$N_5$,$N_5$') hexane dihydrochloride, omega:omega-di-($N_1$,$N_1$'-phenyldiguanido-$N_5$,$N_5$')-di-n-propyl ether dihydrochloride, omega:omega'-di-($N_1$,$N_1$'-p-chlorophenyldiguanido-$N_5$, $N_5$')-di-n-propyl ether tetrahydrochloride, 1,6-di-($N_1$,$N_1$'-2,4-dichlorophenyldiguanido-$N_5$,$N_5$')hexane tetrahydrochloride, 1,6-di-($N_1$,$N_1$'-p-methylphenyldiguanido-$N_5$,$N_5$') hexane dihydrochloride, 1,6-di-($N_1$,$N_1$'-2,4,5-trichlorophenyldiguanido-$N_5$,$N_5$')hexane tetrahydrochloride, 1,6-di-[$N_1$,$N_1$'-alpha-(p-chlorophenyl) ethyldiguanido-$N_5$,$N_5$']hexane dihydrochloride, omega: omega-di-($N_1$,$N_1$'-p-chlorophenyldiguanido-$N_5$,$N_5$')m-xylyl dihydrochloride, 1,12-di-($N_1$,$N_1$'-p-chlorophenyldiguanido-$N_5$,$N_5$')dodecane dihydrochloride, 1,10-di-($N_1$,$N_1$'-phenyldiguanido-$N_5$,$N_5$')decane tetrahydrochloride, 1,12-di-($N_1$, $N_1$'-phenyldiguanido-$N_5$,$N_5$')dodecane tetrahydrochloride, 1,6-di-($N_1$,$N_1$'-o-chlorophenyldiguanido-$N_5$,$N_5$')hexane dihydrochloride, 1,6-di-($N_1$,$N_1$'-o-chlorophenyldiguanido-$N_5$,$N_5$')hexane tetrahydrochloride, ethylenebis(1-tolylbiguanide), ethylenebis(p-tolylbiguanide), ethylenebis(3,5-dimethylphenylbiguanide), ethylenebis(p-tert-amylphenylbiguanide), ethylenebis(nonylphenylbiguanide), ethylenebis(phenylbiguanide), ethylenebis(N-butylphenylbiguanide), ethylenebis(2,5-diethoxyphenylbiguanide), ethylenebis(2,4-dimethylphenylbiguanide), ethylenebis(o-diphenylbiguanide), N-butyl ethylene-bis(phenylbiguanide), trimethylenebis(o-tolylbiguanide), N-butyl trimethylene-bis (phenylbiguanide) and the corresponding salts such as acetates, gluconates, hydrochlorides, hydrobromides, citrates, bisulfites, fluorides, polymaleates, N-cocoalkyl sarcosinates, phosphites, hypophosphites, perfluorooctanoates, silicates, sorbates, salicylates, maleates, tartrates, fumarates, ethylenediamine tetraacetates, imino diacetates, cinnamates, thiocyanates, arginates, pyromellitates, tetracarboxybutyrates, benzoates, glutarates, monofluorophosphates and perfluoropropionates as well as any mixtures thereof.

Also suitable are halogenated xylene and cresol derivatives, such as p-chlorometacresol or p-chlorometaxylene.

Preferably, the biocidal compound is a quaternary ammonium compound. Quaternary ammonium compounds (QACs) suitable as active biocidal substances have the general formula $$(R^1)(R^2)(R^3)(R^4)N^+X^-$$

wherein $R^1$ to $R^4$ are the same or different $C_1$-$C_{22}$ alkyl residues, $C_7$-$C_{28}$ aralkyl residues or heterocyclic residues, wherein two or, in the case of aromatic bonding as in pyridine, even three residues form the heterocycle (e.g., a pyridinium or imidazolinium compound) together with the nitrogen atom, and $X^-$ are halide ions, sulfate ions, hydroxide ions or similar anions.

QACs can be produced by reacting tertiary amines with alkylating agents such as methyl chloride, benzyl chloride, dimethyl sulfate, dodecyl bromide and ethylene oxide. Alkylation of tertiary amines with a long alkyl residue and two methyl groups is achieved particularly readily, and even quaternization of tertiary amines with two long residues and a methyl group can be carried out under mild conditions with the aid of methyl chloride. Amines having three long alkyl residues or hydroxy-substituted alkyl residues are of low reactivity and are preferably quaternized with dimethyl sulfate.

Suitable QACs include benzalkonium chloride (N-alkyl-N,N-dimethylbenzylammonium chloride, CAS No. 8001-54-5), benzalkon B (m,p-dichlorobenzyldimethyl-$C_{12}$-alkylammonium chloride, CAS No. 58390-78-6), benzoxonium chloride (benzyklodecylbis(2-hydroxyethyl)ammonium chloride), cetrimonium bromide (N-hexadecyl-N,N,N-trimethylammonium bromide, CAS No. 57-09-0), benzethonium chloride (N,N-dimethyl-N-[2-[2-[p-(1,1,3,3-tetramethylbutyl)phenoxy]ethoxy]ethyl]benzylammonium chloride, CAS No. 121-54-0), dialkyldimethylammonium chlorides such as di-n-decyldimethyl-ammonium chloride (CAS No. 7173-51-5-5), didecyldimethylammonium bromide (CAS No. 2390-68-3), dioctyldimethylammonium chloride, 1-cetylpyridinium chloride (CAS No. 123-03-5) and thiazoline iodide (CAS No. 15764-48-1) and mixtures thereof. Particularly preferred QACs are dialkyldimethylammonium chlorides, in particular di-n-decyldimethylammonium chloride, N-octadecyl-N,N,N-trimethylammonium chloride, N-hexadecyl-N,N,N-trimethylammonium chloride and the benzalkonium chlorides with $C_8$-$C_{18}$ alkyl residues, in particular $C_{12}$-$C_{14}$ alkylbenzyldimethylammonium chloride. Another preferred biocidal compound is methyl-N-(2-hydroxyethyl)-N,N-di (caproyloxyethyl)ammonium methosulfate. Apart from the fact that these biocidal compounds act effectively against numerous microorganisms, the cationic compounds absorb particularly well on to cotton-containing fabrics and mixed fabrics.

Dialkyldimethylammonium halides, benzalkonium halides and/or substituted benzalkonium halides are commercially available, for example, as Barquat® from Lonza, Marquat® from Mason, Variquat® from Evonik Industries and Hyamine® from Lonza.

The biocidal compound is used in an amount of 0.1 wt. % to 20 wt. %, preferably 0.5 wt. % to 10 wt. % and particularly preferably 1 wt. % to 5 wt. %. It is particularly preferred from a toxicological and ecological viewpoint that the quantity of biocidal compound is less than 2.5 wt. %.

The textile treatment agent contains a perfume composition in order to impart a pleasant scent to laundry treated therewith, as well as to the textile treatment agent itself.

In a preferred embodiment, the textile treatment agent contains the perfume composition in an amount of usually up to 2 wt. %, preferably 0.01 to 1 wt. %, particularly 0.02 to 0.75 wt. % and particularly preferably 0.04 to 0.4 wt. %.

The perfume composition can contain individual fragrance compounds such as synthetic products of esters, ethers, aldehydes, ketones, alcohols and hydrocarbons. Preferably, mixtures of various fragrances are used in combination to produce an attractive scent. The perfume composition can also contain natural fragrance compounds obtained from plant sources.

The perfume composition of the textile treatment agent can also contain at least one aromatherapy component. An essential oil may preferably be used as the aromatherapy component.

Essential oils are extracted, for example, from flowers, spices, herbs, woods or fibers, and are complex mixtures of various organic molecules such as terpenes, ethers, coumarines, esters, aldehydes, phenyl esters, monoterpenols, phenols, monoterpenes, oxides, sesquiterpene ketones, sesquiterpenes and sesquiterpenols. As a result of their small molecular structure, essential oils pass via the skin and/or mucous membrane into the blood circulation and the tissue. In this way they can influence the entire organism.

A wide variety of essential oils may be used in textile treatment agents according to the invention. Suitable essential oils include oils of *Abies sibirica, Amyris balsamifera*, star anise (*Illicium verum*), lemon balm (*Melissa officinalis*), basil (*Ocimum basilicum*), *Pimenta acris*, scarlet beebalm (*Monarda didyma*), bergamot (*Citrus aurantium bergamia*), white birch (*Betula alba*), bitter orange (*Citrus aurantium amara*), hibiscus, cabbage rose (*Rosa centifolia*), *Calendula officinalis*, California nutmeg (*Torreya californica*), *Camellia sinensis, Capsicum frutescens* oleoresin, caraway (*Carum carvi*), cardamom (*Elettaria cardamomum*), cedarwood (*Cedrus atlantica*), *Chamaecyparis obtusa*, chamomile (*Anthemis nobilis*), cinnamon (*Cinnamomum cassia*), citronella grass (*Cymbopogon nardus*), clary sage (*Salvia sclarea*), clove (*Eugenia caryophyllus*), coriander (*Coriandrum sativum*), coriander seeds, *Cyperus esculentus*, cypress (*Cupressus sempervirens*), *Eucalyptus citriodora, Eucalyptus globulus*, fennel (*Foeniculum vulgare*), *Gardenia florida, Geranium maculatum*, ginger (*Zingiber officinale*), gold of pleasure (*Camelina sativa*), grapefruit (*Citrus grandis*), hops (*Humulus lupulus*), *Hypericum perforatum, Hyptis suaveolens*, indigo bush (*Dalea spinosa*), jasmine (*Jasminum officinale*), *Juniperus communis, Juniperus virginiana*, labdanum (*Cistus labdaniferus*), bay (*Laurus nobilis*), lavandin (*Lavandula hybrida*), lavender (Lavandula angustifolia), lemon (*Citrus medica limonum*), lemongrass (*Cymbopogon schoenanthus*), *Leptospermum scoparium*, lime (*Citrus aurantifolia*), linden (*Tilia cordata*), *Litsea cubeba*, lovage (*Levisticum officinale*), *Citrus nobilis*, massoy bark, German chamomile (*Chamomilla recutita*), Morrocan chamomile, musk rose (*Rosa moschata*), myrrh (*Commiphora myrrha*), myrtle (*Myrtus Communis*), *Picea excelsa*, nutmeg (*Myristica fragrans*), *Olax dissitiflora*, olibanum, opoponax, orange (*Citrus aurantium dulcis*), palmarosa (*Cymbopogon martini*), parsley seeds (*Carum petroselinum*), passionflower (*Passiflora incamata*), patchouli (*Pogostemon cablin*), *Pelargonium graveolens*, pennyroyal (*Mentha pulegium*), peppermint (*Mentha piperita*), pine (*Pinus palustris*), *Pinus pinea, Pinus pumilio, Pinus sylvestris*, rosemary (*Rosmarinus officinalis*), rose, rosewood (*Aniba rosaeodora*), rue (*Ruta graveolens*), sage (*Salvia officinalis*), *Sambucus nigra*, sandalwood (*Santalum album*), sandarac (*Callitris quadrivalvis*), *Sassafras officinale, Sisymbrium ino*, spearmint (*Mentha viridis*), marjoram (*Origanum majorana*), sweet violet (*Viola odorata*), wood tar, *Thuja occidentalis*, thyme (*Thymus vulgaris*), *Vetiveria zizanoides*, wild mint (*Mentha arvensis*), *Ximenia americana*, yarrow (*Achillea millefolium*), ylang ylang (*Cananga odorata*) and mixtures thereof.

The textile treatment agent also contains a non-ionic surfactant with an HLB value of from 10.5 to 15 and a cloud temperature of at least about 50° C.

The HLB value (abbreviation of "hydrophilic-lipophilic balance") refers to the hydrophilic and lipophilic proportion of mainly non-ionic surfactants, and was proposed in 1954 by W. C. Griffin.

The HLB value of non-ionic surfactants can be calculated as follows:

$$HLB=20\times M_I/M$$

wherein $M_I$ is the molecular mass of the hydrophilic portion of a molecule and M is the molecular mass of the whole molecule. The factor 20 is a scaling factor arbitrarily selected by Griffin. Thus a scale of 1 to 20 is generally obtained. An HLB value of 1 indicates a lipophilic compound, and a chemical compound with an HLB value of 20 has a high hydrophilic proportion.

Water solubility of surfactants is reduced as temperature increases. The loose complex bond between the hydrophilic regions of the surfactant (e.g., the polyglycol ether chain in an ethoxylated surfactant) and the water molecules, which brings about the water solubility, is broken down to a greater or lesser extent by the increasingly strong molecular movement. This process is reversible. Cloud temperature is the temperature at which an aqueous solution of a surfactant suddenly becomes cloudy on heating. It is determined according to DIN 53917.

For water-soluble surfactants, the cloud temperature of a 1% aqueous solution is determined. Where there is a high degree of alkoxylation, the cloud temperature is determined in a NaCl solution.

As non-ionic surfactants having an HLB value of from 10.5 to 15 and a cloud temperature of at least about 50° C. (preferably alkoxylated, advantageously ethoxylated, in particular, primary alcohols with preferably 8 to 18 C atoms and an average of 3 to 12 moles ethylene oxide (EO) per mole alcohol) are used, wherein the alcohol residue can be linear or preferably methyl-branched in the 2-position, or contains a mixture of linear and methyl-branched residues. In particular, alcohol ethoxylates with linear residues from alcohols of natural origin with 12 to 18 C atoms (e.g., from coconut, palm, tallow fatty or oleyl alcohol) and an average of 4 to 8 EO per mole of alcohol are preferred. The degrees of ethoxylation given represent statistical averages, which may be a whole number or a fractional number for a specific product. Preferred alcohol ethoxylates have a narrow distribution of homologs (narrow range ethoxylates, NRE). A particularly preferred non-ionic surfactant is a $C_{12-18}$ alcohol with 7 EO. This ethoxylated fatty alcohol has an HLB value of 11.9 and a cloud temperature in the range of 50 to 56° C.

The amount of non-ionic surfactant having an HLB value of from 10.5 to 15 and a cloud temperature of at least about 50° C. used in a textile treatment agent can be about 0.1 to 5 wt. %, preferably from 0.5 to 1.5 wt. % and particularly preferably from 0.75 to 1 wt. %. A non-ionic surfactant with an HLB value of from 10.5 to 15 and a cloud temperature of at least about 50° C. is capable of stabilizing a perfumed, biocidal textile treatment agent so effectively that it can be used in a small absolute quantity. This is advantageous in that the risk is reduced that, as a result of the presence of foam-forming non-ionic surfactants, too much foam will form during the rinse cycle and remain on the laundry.

In preferred textile treatment agents, therefore, the ratio of non-ionic surfactant to perfume is greater than or equal to 5:1, preferably greater than 6:1, more preferably from 15:1 to 8:1 and particularly preferably from 12:1 to 9:1.

In particular, it has been shown that with a ratio of non-ionic surfactant to perfume of greater than 6:1, more preferably from 15:1 to 8:1 and particularly preferably from 12:1 to 9:1, particularly good stabilizing of the textile treatment agent at storage temperatures of from 0 to 10° C. and in particular at 0° C. occurs.

In addition to the biocidal compound, perfume composition and non-ionic surfactant, the textile treatment agent can also contain other ingredients which further improve the application properties and/or the aesthetic properties of the textile treatment agent. Within the framework of the present invention, preferred textile treatment agents additionally contain one or more softening components, thickeners, builders, electrolytes, non-aqueous solvents, pH adjusters, fluorescent agents, dyes, hydrotopes, foam inhibitors, silicone oils, antiredeposition agents, optical brighteners, graying inhibitors, shrinkage inhibitors, anti-wrinkle agents, color transfer inhibitors, antioxidants, preservatives, corrosion inhibitors, antistatic agents, bittering agents, ironing aids, proofing and impregnating agents, swelling and anti-slip agents, skin-care compounds and/or UV absorbers.

Textile treatment agents in the form of softeners, for example, contain a softening component in addition to the biocidal compound, non-ionic surfactant and perfume composition.

The softening component contain, for example, quaternary ammonium compounds such as monoalk(en)yltrimethylammonium compounds, dialk(en)yldimethylammonium compounds and mono-, di- or triesters of fatty acids with alkanolamines.

Examples of suitable quaternary ammonium compounds are illustrated in formulae (I) and (II)—

(I)

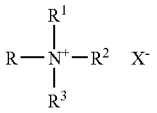

(II)

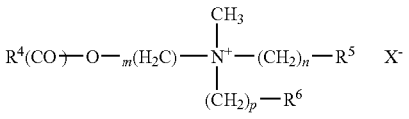

wherein in formula (I) R is an acyclic alkyl residue with 12 to 24 carbon atoms, $R^1$ is a saturated $C_1$-$C_4$ alkyl or hydroxyalkyl residue, $R^2$ and $R^3$ are individually either the same as R or R' or are an aromatic residue; and $X^-$ is a halide, methosulfate, methophosphate or phosphate ion and mixtures of these. Cationic compounds according to formula (I) include monotallow trimethylammonium chloride, mono stearyltrimethylammonium chloride, didecyldimethylammonium chloride, ditallow dimethylammonium chloride, and dihexadecylammonium chloride.

Compounds according to formulae (II), (III) and (IV) are referred to as ester quats. Ester quats are distinguished by excellent biodegradability. In formula (II), $R^4$ is an aliphatic alk(en)yl residue with 12 to 22 carbon atoms with 0, 1, 2 or 3 double bonds and/or optionally with substituents; $R^5$ is H, OH or $O(CO)R^7$; $R^6$ independently of $R^5$ is H, OH or $O(CO)R^8$; where $R^7$ and $R^8$ are independently an aliphatic alk(en)yl residue with 12 to 22 carbon atoms with 0, 1, 2 or 3 double bonds; m, n and p are each independently a value of 1, 2 or 3; $X^-$ is a halide, methosulfate, methophosphate or phosphate ion and mixtures of these anions. Preferred are compounds in which $R^5$ is the group $O(CO)R^7$. Particularly preferred are compounds in which $R^5$ is the group $O(CO)R^7$ and $R^4$ and $R^7$ are alk(en)yl residues with 16 to 18 carbon atoms. Most particularly preferred are compounds in which $R^6$ additionally is OH. Examples of compounds of formula (I) include methyl-N-(2-hydroxyethyl)-N,N-di(tallow acyloxyethyl) ammonium methosulfate, bis(palmitoyl oxyethyl)hydroxyethyl methyl ammonium methosulfate, 1,2-bis[tallow acyloxy]-3-trimethylammonium propane chloride or methyl-N, N-bis(stearoyloxyethyl)-N-(2-hydroxyethyl)ammonium methosulfate.

If quaternized compounds of formula (II) are used which have unsaturated alkyl chains, the acyl groups whose corresponding fatty acids have an iodine number of from 1 to 100, preferably from 5 to 80, more preferably from 10 to 60 and in particular from 15 to 45, and which have a cis/trans isomer ratio (in wt. %) of greater than 30:70, preferably greater than 50:50 and in particular equal to or greater than 60:40, are preferred. Commercial examples include methylhydroxyalkyldialkoyloxyalkylammonium methosulfates marketed by Stepan with the trade mark Stepantex® or products from Cognis known as Dehyquart®, products from Degussa known as Rewoquat® or products from Kao known as Tetranyl®. Other preferred compounds include diester quats according to formula (III), commercially available under the tradename Rewoquat® 222 LM or CR 3099—

(III)

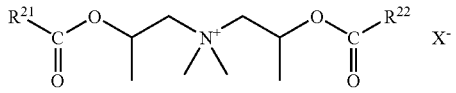

$R^{21}$ and $R^{22}$ are each independently an aliphatic residue with 12 to 22 carbon atoms with 0, 1, 2 or 3 double bonds.

Instead of the ester group O(CO)R where R is a long-chain alk(en)yl residue, softening compounds can be used which have the following groups: RO(CO), N(CO)R or RN(CO), with N(CO)R groups being preferred.

In addition to the quaternary compounds described above, it is also possible to use other compounds as the softening component such as quaternary imidazolinium compounds of formula (IV)—

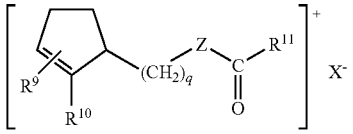

(IV)

wherein $R^9$ is H or a saturated alkyl residue with 1 to 4 carbon atoms, $R^{10}$ and $R^{11}$ are each independently an aliphatic, saturated or unsaturated alkyl residue with 12 to 18 carbon atoms, $R^{10}$ may alternatively also be $O(CO)R^{20}$, wherein $R^{20}$ is an aliphatic, saturated or unsaturated alkyl residue with 12 to 18 carbon atoms, and Z is an NH group or oxygen; and $X^-$ is an anion; q can assume whole number values of from 1 to 4.

Other particularly preferred softening compounds are described by formula (V)—

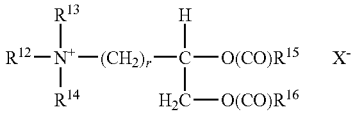

(V)

wherein $R^{12}$, $R^{13}$ and $R^{14}$ are each independently a $C_{1-4}$ alkyl, alkenyl or hydroxyalkyl group; $R^{15}$ and $R^{16}$ are each independently a $C_{8-28}$ alkyl group; $X^-$ is an anion, and r is a number from 0 to 5. A preferred example of a cationic deposition aid according to formula (V) is 2,3-bis[tallow acyloxy]-3-trimethylammonium propane chloride Other softening components that can be used according to the invention are represented by quaternized protein hydrolysates or protonated amines.

Cationic polymers are also a suitable softening component. Suitable cationic polymers include polyquaternium polymers as cited in the CTFA Cosmetic Ingredient Dictionary (The Cosmetic, Toiletry and Fragrance, Inc., 1997), particularly polyquaternium-6, polyquaternium-7 and polyquaternium-10 polymers (polymer JR, LR and KG series from Amerchol) also known as Merquats, polyquaternium-4 copolymers, such as graft copolymers with a cellulose framework and quaternary ammonium groups which are bonded via allyldimethylammonium chloride, cationic cellulose derivatives, such as cationic guar, such as guar hydroxypropyltriammonium chloride, and similar quaternized guar derivatives (e.g., Cosmedia guar from Cognis or the Jaguar series from Rhodia), cationic quaternary sugar derivatives (cationic alkyl polyglucosides), for example, the commercial product Glucquat® 100, according to CTFA nomenclature a "lauryl methyl gluceth-10 hydroxypropyl dimonium chloride", copolymers of PVP and dimethylaminomethacrylate, copolymers of vinylimidazole and vinylpyrrolidone, aminosilicone polymers and copolymers.

It is also possible to use polyquaternized polymers (e.g. Luviquat® Care from BASF) and also cationic biopolymers based on chitin and derivatives thereof, for example the polymer available with the trade name Chitosan® (manufacturer: Cognis).

Some of the aforementioned cationic polymers additionally have skin-care or textile care properties.

It is also possible to use compounds of formula (VI)—

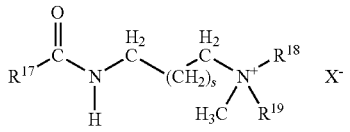

(VI)

$R^{17}$ may be an aliphatic alk(en)yl residue with 12 to 22 carbon atoms with 0, 1, 2 or 3 double bonds; s may assume values from 0 to 5. $R^{18}$ and $R^{19}$ are each independently H, $C_{1-4}$ alkyl or hydroxyalkyl; and $X^-$ is an anion.

Other suitable softening components include protonated or quaternized polyamines.

Particularly preferred softening components are alkylated quaternary ammonium compounds, of which at least one alkyl chain is interrupted by an ester group and/or amido group. N-Methyl-N-(2-hydroxyethyl)-N,N-(ditallow acyloxyethyl)ammonium methosulfate or bis(palmitoyloxyethyl)hydroxyethyl methyl ammonium methosulfate are most particularly preferred.

In a softener as textile treatment agent according to the invention, the softening component is present in amounts of 0.1 to 80 wt. %, generally 1 to 40 wt. %, preferably 2 to 20 wt. % and in particular 3 to 15 wt. %, based on total weight of the textile treatment agent.

Carbonates and salts of organic di- and polycarboxylic acids as well as mixtures of these substances should be mentioned in particular as builders that can be contained in the textile treatment agents. The latter encompass for example polyacrylates and acrylic acid/maleic acid copolymers, polyaspartates and monomeric polycarboxylates such as citrates, gluconates, succinates or malonates, which are preferably used as sodium salts.

The textile treatment agent may contain a thickening agent. Thickening agents include a polyacrylate thickener, xanthan gum, gellan gum, guar gum, alginate, carrageenan, carboxymethylcellulose, bentonite, wellan gum, locust bean gum, agar-agar, tragacanth, gum arabic, pectins, polyoses, starch, dextrins, gelatins and casein. However, it is also possible to use modified natural substances such as modified starches and celluloses as thickeners. Carboxymethyl cellulose and other cellulose ethers, hydroxyethyl and hydroxypropyl celluloses and gum ethers may be mentioned here as examples.

Polyacrylic and polymethacrylic thickeners include high molecular weight homopolymers of acrylic acid crosslinked with a polyalkenyl polyether, in particular, an allyl ether of sucrose, pentaerythritol or propylene (INCI name according to the "International Dictionary of Cosmetic Ingredients" of "The Cosmetic, Toiletry, and Fragrance Association (CTFA)": carbomers), also known as carboxyvinyl polymers. Such polyacrylic acids are obtainable inter alia from 3V Sigma under the trade name Polygel® (e.g., Polygel DA), and from B.F. Goodrich under the trade name Carbopol® (e.g., Carbopol 940 (molecular weight approx. 4,000,000), Carbopol 941 (molecular weight approx. 1,250,000) or Carbopol 934 (molecular weight approx. 3,000,000)). They also include the following acrylic acid copolymers: (i) copolymers of two or more monomers from the group of acrylic acid, methacrylic acid and the simple esters thereof, preferably formed with $C_{1-4}$ alkanols (INCI: acrylates copolymer), which include for instance the copolymers of methacrylic acid, butyl acrylate and methyl methacrylate (CAS number according to Chemical Abstracts Service: 25035-69-2) or of butyl acrylate and methyl methacrylate (CAS 25852-37-3), and which are obtainable, for example, from Rohm & Haas under the trade names Aculyn® and Acusol® and from Degussa (Goldschmidt) under the trade name Tego® Polymer, e.g. the anionic non-associative polymers Aculyn 22, Aculyn 28, Aculyn 33 (crosslinked), Acusol 810, Acusol 820, Acusol 823 and Acusol 830 (CAS 25852-37-3); (ii) crosslinked high molecular weight acrylic acid copolymers, which include for instance the copolymers, crosslinked with an allyl ether of sucrose or of pentaerythritol, of $C_{10-30}$ alkyl acrylates with one or more monomers from the group of acrylic acid, methacrylic acid and the simple esters thereof, preferably formed with $C_{1-4}$ alkanols (INCI: acrylates/$C_{10-30}$ alkyl acrylate crosspolymer) and which are obtainable for example from B.F. Goodrich under the trade name Carbopol®, e.g. hydrophobized Carbopol ETD 2623 and Carbopol 1382 (INCI acrylates/$C_{10-30}$ alkyl acrylate crosspolymer) and Carbopol Aqua 30 (formerly Carbopol EX 473). Cationic poly(meth)acrylic thickeners are particularly preferably used.

Preferred textile treatment agents contain, based on total weight of the textile treatment agent, 0.01 to 3 wt. % and preferably 0.1 to 1 wt. % thickener. The amount of thickener used depends on the type of thickener and the desired degree of thickening.

As electrolytes from the group of the inorganic salts, it is possible to use a broad range of many different salts. Preferred cations are the alkali and alkaline earth metals; preferred anions are the halides and sulfates. From a manufacturing perspective, use of NaCl or $MgCl_2$ in the textile treatment agents is preferred. The proportion of electrolytes in the textile treatment agents is generally 0.01 to 2 wt. %.

Non-aqueous solvents which can be used in the textile treatment agents include monohydric or polyhydric alcohols, alkanolamines or glycol ethers, provided that they are miscible with water in the concentration range given. The solvents are preferably chosen from ethanol, n- or i-propanol, butanols, glycol, propanediol or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or ethyl ether, di-isopropylene glycol monomethyl or ethyl ether, methoxy, ethoxy or butoxy triglycol, 1-butoxyethoxy-2-propanol, 3-methyl-3-methoxybutanol, propylene glycol t-butyl ether and mixtures of these solvents. Non-aqueous solvents can be used in textile treatment agents in amounts of from 0.5 to 15 wt. %, preferably less than 9 wt. %, and in particular less than 5 wt. %, based on total weight of the agent.

In another embodiment, the textile treatment agent additionally contains 0.5 to 5 wt. %, preferably 1 to 2.5 wt. % ethanol and/or isopropanol. Ethanol and isopropanol not only support the stabilizing of the perfume composition, but also provide a biocidal action. Thus, not only is stability of the textile treatment agent improved, but the spectrum of action of the textile treatment agent is also extended.

The viscosity of textile treatment agents can be measured using conventional standard methods (e.g., a Brookfield viscometer LVT-II at 20 rpm and 20° C., spindle 2) and is preferably 5 to 4000 mPas, with values from 10 to 2000 mPas being particularly preferred. The viscosity of softeners is most particularly preferably from 10 to 1000 mPas.

In order to bring the pH of the textile treatment agents into the desired range, pH adjusters may be used. All known acids or lyes may be used here, provided that their use is not prohibited for reasons of application technology or on ecological grounds, or for reasons of consumer protection.

To improve the aesthetic impression of the textile treatment agents, they can be colored using suitable dyes. Preferred dyes, the selection of which offers no problem one skilled in the art, possess high storage stability, are not sensitive to the other ingredients of the textile treatment agents and to light, and have no marked substantivity towards textile fibers so that they do not color these.

Soaps, paraffins or silicone oils, for example, which may optionally be applied on to support materials, are suitable as foam inhibitors used in the textile treatment agents.

Suitable soil release polymers, also referred to as "antiredeposition agents", include non-ionic cellulose ethers such as methyl cellulose and methyl hydroxypropyl cellulose with a proportion of 15 to 30 wt. % methoxy groups and 1 to 15 wt. % hydroxypropyl groups, each based on the non-ionic cellulose ether, and the polymers of phthalic acid and/or terephthalic acid or their derivatives known from the prior art, in particular, polymers of ethylene terephthalates and/or polyethylene and/or polypropylene glycol terephthalates or anionically and/or non-ionically modified derivatives thereof. Suitable derivatives include sulfonated derivatives of phthalic acid and terephthalic acid polymers.

Optical brighteners (so-called "whiteners") can be added to the textile treatment agents to eliminate graying and yellowing of the treated textile fabrics. These substances absorb on to the fiber and cause a brightening and simulated bleaching effect by converting invisible ultraviolet radiation into visible longer-wave light (ultraviolet light absorbed from sunlight being irradiated away as weak bluish fluorescence) and result in pure white with the yellow shade of the grayed or yellowed laundry. Suitable compounds include 4,4'-diamino-2,2'-stilbenedisulfonic acids (flavonic acids), 4,4'-distyrylbiphenylene, methyl umbelliferone, coumarins, dihydroquinolinones, 1,3-diarylpyrazolines, naphthalic acid imides, benzoxazole, benzisoxazole and benzimidazole systems as well as heterocyclic substituted pyrene derivatives. Optical brighteners are usually used in amounts of from 0% to 0.3 wt. %, based on total weight of the finished washing and cleaning agent.

Graying inhibitors maintain dirt removed from fibers in suspension in the washing solution, thereby preventing the dirt from resettling. Water-soluble colloids of mostly organic nature are suitable for this, for example, glue, gelatins, salts of ether sulfonic acids of starch or cellulose, or salts of acidic sulfuric acid esters of cellulose or starch. Water-soluble, acid group-containing polyamides are also suitable for this purpose. In addition, soluble starch preparations and starch products other than those mentioned above can be used, e.g. degraded starch, aldehyde starches etc. Polyvinyl pyrrolidone can also be used. Preference, however, is given to the use of cellulose ethers such as carboxymethyl cellulose (Na salt), methyl cellulose, hydroxyalkyl cellulose and mixed ethers such as methyl hydroxyethyl cellulose, methyl hydroxypropyl cellulose, methyl carboxymethyl cellulose and mixtures thereof, in amounts of 0.1 to 5 wt. %, based on the textile treatment agents.

In order effectively to suppress dye bleeding and/or dye transfer on to other textiles during the treatment of dyed textiles, the textile treatment agent can contain a color transfer inhibitor. Preferably the color transfer inhibitor is a polymer or copolymer of cyclic amines such as vinylpyrrolidone and/or vinylimidazole. Polymers suitable as color transfer inhibitors include polyvinylpyrrolidone (PVP), polyvinylimidazole (PVI), copolymers of vinylpyrrolidone and vinylimidazole (PVP/PVI), polyvinylpyridine N-oxide, poly-N-carboxymethyl-4-vinylpyridium chloride and mixtures thereof. It is particularly preferred to use polyvinylpyrrolidone (PVP), polyvinylimidazole (PVI) or copolymers of vinylpyrrolidone and vinylimidazole (PVP/PVI) as color transfer inhibitors. Polyvinylpyrrolidones (PVP) that are used preferably possess an average molecular weight from 2,500 to 400,000, and are available commercially from ISP Chemicals as PVP K 15, PVP K 30, PVP K 60, or PVP K 90, or from BASF as Sokalan® HP 50 or Sokalan® HP 53. Copolymers of vinylpyrrolidone and vinylimidazole (PVP/PVI) that are used preferably have a molecular weight of about 5000 to 100,000. A PVP/PVI copolymer is available commercially, for example from BASF with the name Sokalan® HP 56.

The amount of color transfer inhibitor used, based on total weight of the textile treatment agent, is preferably from 0.01 to 2 wt. %, more preferably from 0.05 to 1 wt. % and most preferably from 0.1 to 0.5 wt. %.

Washing and cleaning agents can contain antioxidants in order to prevent undesired changes due to the action of oxygen and other oxidative processes to the textile treatment agents and/or the treated textile fabrics. These compounds include substituted phenols, hydroquinones, catechols and aromatic amines, as well as organic sulfides, polysulfides, dithiocarbamates, phosphites, phosphonates and vitamin E.

Increased wear comfort can result from the additional use of antistatic agents added to the textile treatment agents. Antistatic agents increase surface conductivity, making possible improved dissipation of charges that have formed. External antistatic agents are usually substances having at least one hydrophilic molecule ligand, and yield a more or less hygroscopic film on surfaces. These usually surface-active antistatic agents can be subdivided into nitrogen-containing (amines, amides, quaternary ammonium compounds), phosphorus-containing (phosphoric acid esters) and sulfur-containing antistatic agents (alkyl sulfonates, alkyl sulfates). Lauryl (or stearyl)dimethylbenzylammonium chlorides are suitable as antistatic agents for textile fabrics or as an additive to textile treatment agents, in which case an additional lubricating effect is achieved.

In order to improve rewettability of the treated textile fabrics and facilitate ironing of the treated textile fabrics, silicone derivatives can be used in the textile treatment agents. These also improve the rinsing behavior of the washing and cleaning agents due to their foam-inhibiting properties. Preferred silicone derivatives include polydialkyl or alkylaryl siloxanes wherein the alkyl groups have one to five C atoms and are entirely or partly fluorinated. Preferred silicones are polydimethylsiloxanes, which can optionally be derivatized and are then aminofunctional or are quaternized or have Si—OH, Si—H and/or Si—CI bonds.

The textile treatment agent can also include a skin-care compound.

Skin-care compounds are compounds or mixture of compounds that, upon contact between a textile and the washing agent, absorbs onto the textile and, upon contact between the textile and skin, imparts to the skin an advantage compared with a textile that was not treated with the textile treatment agent according to the invention. Advantages include transfer of the skin-care compound from the textile to the skin, a decreased transfer of water from the skin to the textile or decreased friction on the skin surface as a result of the textile.

The skin-care compound is preferably hydrophobic, can be liquid or solid and must be compatible with the other ingredients of the textile treatment agent. Skin-care compounds include— a) waxes such as carnauba, spermaceti, beeswax, lanolin, derivatives thereof and mixtures thereof;
b) plant extracts, for example, vegetable oils such as avocado oil, olive oil, palm oil, palm kernel oil, rapeseed oil, linseed oil, soy oil, peanut oil, coriander oil, castor oil, poppy-seed oil, cocoa oil, coconut oil, pumpkin seed oil, wheat germ oil, sesame oil, sunflower oil, almond oil, macadamia nut oil, apricot kernel oil, hazelnut oil, jojoba oil or canola oil, chamomile, aloe vera, and mixtures thereof;
c) higher fatty acids such as lauric acid, myristic acid, palmitic acid, stearic acid, behenic acid, oleic acid, linoleic acid, linolenic acid, isostearic acid or polyunsaturated fatty acids;
d) higher fatty alcohols such as lauryl alcohol, cetyl alcohol, stearyl alcohol, oleyl alcohol, behenyl alcohol or 2-hexadecanol;
e) esters such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate or alkyl tartrate;
f) hydrocarbons such as paraffins, mineral oils, squalane or squalene;
g) lipids;
h) vitamins such as vitamin A, C, or E or vitamin alkyl esters;
i) phospholipids;
j) sun protectants such as octyl methoxycinnamate and butylmethoxybenzoylmethane;
k) silicone oils, such as linear or cyclic polydimethylsiloxanes, amino-, alkyl-, alkylaryl-, or aryl-substituted silicone oils; and
l) mixtures thereof.

The amount of skin-care compound is preferably from 0.01 to 10 wt. %, more preferably from 0.1 to 5 wt. % and most particularly preferably from 0.3 to 3 wt. %, based on total weight of the textile treatment agent.

Lastly, the textile treatment agents can also contain UV absorbers, which are absorbed on to the treated textile fabrics and improve the light-fastness of the fibers. Compounds that exhibit these desired properties include compounds that act by radiationless deactivation and derivatives of benzophenone having substituents in the 2- and/or 4-position. Also suitable are substituted benzotriazoles, acrylates phenyl-substituted in the 3-position (cinnamic acid derivatives) optionally having cyano groups in the 2-position, salicylates, organic Ni complexes and natural substances such as umbelliferone and endogenous urocanic acid.

The textile treatment agents can be produced by techniques for producing softeners, wash aids and post-treatment agents familiar to one skilled in the art. This includes mixing the raw materials, optionally using high-shear mixing equipment. In the case of softeners as textile treatment agents it is recommended to melt the softening component(s) followed by dispersing the melt in a solvent, preferably water. The other ingredients can be integrated into the softeners by simply admixing.

Table 1 shows various textile treatment agents (all quantities are given in wt. % active substance, based on the agent).

TABLE 1

| | E1 | E2 | E3 | E4 | E5 | E6 | V1 | V2 | V3 | V4 |
|---|---|---|---|---|---|---|---|---|---|---|
| Didecyl dimethyl ammonium chloride | 2.40 | 2.40 | 2.40 | 2.40 | 2.40 | 2.40 | 2.40 | 2.40 | 2.40 | 2.40 |
| $C_{12-18}$ fatty alcohol with 7 EO | 1.50 | 1.20 | 1.00 | 0.90 | 0.90 | 1.00 | — | — | — | — |
| $C_{12-18}$ fatty alcohol with 5 EO | — | — | — | — | — | — | — | — | — | — |
| $C_{13-15}$ oxo fatty alcohol with 7 EO | — | — | — | — | — | — | — | — | — | — |
| Hydrogenated castor oil with 40 EO | — | — | — | — | — | — | — | — | 0.10 | 0.10 |
| Perfume composition | 0.10 | 0.10 | 0.10 | 0.10 | 0.10 | 0.10 | 0.05 | 0.10 | — | 0.10 |
| Cationic polyacrylate thickener | 0.15 | 0.15 | 0.15 | 0.15 | 0.15 | 0.15 | — | — | — | — |
| Ester quat* | — | — | — | — | 10 | — | — | — | — | — |
| Ethanol | — | — | — | — | — | 1.00 | — | — | — | — |
| Isopropanol | 1.00 | 1.00 | 1.00 | 1.00 | 1.00 | 1.00 | 1.00 | 1.00 | 1.00 | 1.00 |
| Dye | — | — | + | — | — | — | — | — | — | — |
| Water | To 100 | To 100 | To 100 | To 100 | To 100 | To 100 | To 100 | To 100 | To 100 | To 100 |
| Stability at 0° C. | Clear | Clear | Clear | Clear | Stable | Clear | Phase separation | Phase separation | Clear | Phase separation |

| | V5 | V6 | V7 | V8 | V9 | V10 | V11 | E7 | V12 | V13 |
|---|---|---|---|---|---|---|---|---|---|---|
| Didecyl dimethyl ammonium chloride | 2.40 | 2.40 | 2.40 | 2.40 | 2.40 | 2.40 | 2.40 | 2.40 | 2.40 | 2.40 |
| $C_{12-18}$ fatty alcohol with 7 EO | — | — | — | — | — | — | — | 0.60 | — | — |
| $C_{12-18}$ fatty alcohol with 5 EO | — | — | 0.60 | 0.90 | 1.20 | 1.50 | 0.50 | — | — | — |
| $C_{13-15}$ oxo fatty alcohol with 7 EO | — | — | — | — | — | — | — | — | 0.60 | 0.80 |
| Hydrogenated castor oil with 40 EO | 1.50 | — | — | — | — | — | 0.30 | — | — | — |
| Perfume composition | 0.10 | 0.10 | 0.10 | 0.10 | 0.10 | 0.10 | 0.10 | 0.10 | 0.10 | 0.10 |
| Cationic polyacrylate thickener | — | — | — | — | — | — | 0.15 | — | 0.15 | 0.15 |
| Ester quat* | — | — | — | — | — | — | — | — | — | — |
| Ethanol | 1.00 | 4.0 | — | — | — | — | — | — | — | — |
| Isopropanol | 1.00 | 1.00 | 1.00 | 1.00 | 1.00 | 1.00 | 1.00 | 1.00 | 1.00 | 1.00 |
| Dye | — | — | — | — | — | — | + | — | + | + |
| Water | To 100 | To 100 | To 100 | To 100 | To 100 | To 100 | To 100 | To 100 | To 100 | To 100 |
| Stability at 0° C. | Phase separation | Phase separation | Phase separation | Phase separation | Phase separation | Phase separation | Phase separation | Cloudy | Phase separation | Phase separation |

*N-methyl-N-(2-hydroxyethyl)-N,N-(ditallow acyloxyethyl)ammonium methosulfate

Table 2 shows HLB values and cloud temperatures (determined in accordance with DIN 53917) of non-ionic surfactants used.

TABLE 2

| Non-ionic surfactant | HLB value | Cloud point [° C.] |
|---|---|---|
| $C_{12-18}$ fatty alcohol with 7 EO | 11.9 | 50-56*** |
| $C_{12-18}$ fatty alcohol with 5 EO | 10.3 | — |
| $C_{13-15}$ oxo fatty alcohol with 7 EO | 11.8 | 43*** |
| Hydrogenated caster oil with 40 EO** | 17.1 | 76-82**** |

**Eumulgin HRE 40 (from Cognis)

***1% in $H_20$

****1% in 5% NaCl solution

Textile treatment agents E1 to E6 according to the invention were clear or stable at a storage temperature of 0° C. for 4 weeks.

A comparison of formulations E1 to E4 according to the invention with comparative formulations V7 to V10 and V14 clearly shows that the non-ionic surfactant must have an HLB value of between 10.5 and 15 and a cloud temperature of at least 50° C. for the biocidal textile treatment agents to be effectively stabilized against phase separation.

Table 3 shows another textile treatment agent according to the invention E7, which was stable for 4 weeks at room temperature (all quantities given in wt. % active substance, based on total weight of the agent).

TABLE 3

| Textile Treatment Agent | E7 |
|---|---|
| Didecyl dimethyl ammonium chloride | 2.40 |
| $C_{12-18}$ fatty alcohol with 7 EO | 0.50 |
| $C_{12-18}$ fatty alcohol with 5 EO | — |
| $C_{13-15}$ oxo fatty alcohol with 7 EO | — |
| Hydrogenated castor oil with 40 EO | — |
| Perfume composition | 0.10 |
| Cationic polyacrylate thickener | 0.15 |
| Ester quat* | — |
| Ethanol | — |
| Isopropanol | 1.00 |
| Dye | — |
| Water | To 100 |
| Stability at 23° C. | Clear |

Textile treatment agent E3 according to the invention was subjected to a number of microbiological investigations—

1. Determination of the "Limited" Virucidal Activity Following the Guideline of the DVV [Deutsche Vereinigung zur Bekämpfung der Viruskrankheiten, German Association for the Control of Virus Diseases] (Bundesgesundheitsblatt-Gesundheitsforschung-Gesundheitsschutz 2005 48: 1420-1426)—

This test showed that, without a protein load, within a contact time of 5 minutes and in an application concentration of 0.53 wt. %, following the DVV guideline, textile treatment agent E3 produces a destruction of more than $10^4$ against the test viruses used (vaccinia virus, Elstree strain and bovine viral diarrhea virus (BVDV), NADL strain).

2. Determination of Bacteriostatic Activity in Accordance with EN 1276—

This test showed that, within a contact time of 5 minutes and at an application concentration of 0.53 wt. %, textile treatment agent E3 causes a reduction in viability of more than $10^5$ against the reference strains used—*Staphylococcus aureus, Escherichia coli* and *Enterococcus hirae*—and a reduction in viability of more than $10^4$ against the test strain *Pseudomonas aeruginosa.*

3. Determination of Fungicidal Activity in Accordance with EN 1650—

This test showed that at 20° C., within a contact time of 15 minutes and at an application concentration of 0.53 wt. %, textile treatment agent E3 causes a reduction in viability of more than $10^4$ against the reference strain used, *Candida albicans.*

In addition, textile treatment agent E3, when used in the rinse cycle of an automatic washing process, imparts a pleasant scent and a softness of 3.3 on a scale of 0 (hard) to 6 (soft) to terry towels treated therewith. A rinse cycle without textile treatment agent E3 and with only water gave a softness of 0.6. Softness was determined by a panel of experts.

We claim:

1. Textile treatment agent comprising:

a biocidal compound used in an amount of 0.1 wt. % to 2.5 wt. % based on total weight of the agent, wherein the biocidal compound is a quaternary ammonium compound chosen from dialkyldimethylammonium halides, wherein the dialkyldimethylammonium halide is selected from the group consisting of di-n-decyldimethylammonium chloride, didecyldimethylammonium bromide and dioctyldimethylammonium chloride, a perfume composition, and a non-ionic surfactant, wherein the non-ionic surfactant has an HLB value of from 10.5 to 15 and a cloud temperature of at least 50° C., and wherein the ratio of non-ionic surfactant to perfume composition is greater than or equal to 5:1.

2. Textile treatment agent according to claim 1, wherein the non-ionic surfactant has an HLB value of from 11 to 14.

3. Textile treatment agent according to claim 1, wherein the non-ionic surfactant is an alkoxylated fatty alcohol.

4. Textile treatment agent according to claim 3, wherein the non-ionic surfactant is an ethoxylated and/or propoxylated $C_{12}$-$C_{18}$ fatty alcohol.

5. Textile treatment agent according to claim 1, wherein the ratio of non-ionic surfactant to perfume is from 8:1 to 15:1.

6. Textile treatment agent according to claim 1, wherein the textile treatment agent is a softener and further comprises a softening component.

7. Textile treatment agent according to claim 6, wherein the softening component is an alkylated quaternary ammonium compound, wherein at least one alkyl chain is interrupted by an ester or amido group.

8. Textile treatment agent according to claim 1, further comprising a biocidal compound chosen from amines, aldehydes, antimicrobial acids and salts thereof, carboxylic acid esters, acid amides, phenols, phenol derivatives, diphenyls, diphenyl alkanes, urea derivatives, oxygen acetals, oxygen formals, nitrogen acetals, nitrogen formals, benzamidines, isothiazolines, phthalimide derivatives, pyridine derivatives, guanidines, quinolines and mixtures thereof.

9. Textile treatment agent according to claim 1 further comprising 0.5 to 5 wt. %, ethanol and/or isopropanol.

10. Method of stabilizing a textile treatment agent comprising a biocidal compound used in an amount of 0.1 wt. % to 2.5 wt. % based on total weight of the agent, wherein the biocidal compound is a quaternary ammonium compound chosen from dialkyldimethylammonium halides, wherein the dialkyldimethylammonium halide is selected from the group consisting of di-n-decyldimethylammonium chloride, didecyldimethylammonium bromide and dioctyldimethylammonium chloride, and a perfume composition, the method comprising adding a non-ionic surfactant with an HLB value of between 10.5 and 15 and a cloud temperature of at least 50° C. to the textile treatment agent, wherein the ratio of non-ionic surfactant to perfume composition is greater than or equal to 5:1.

11. Method according to claim 10 wherein the textile treatment agent comprising the non-ionic surfactant with an HLB value of from 10.5 to 15 and a cloud temperature of at least 50° C. is stable during storage of the textile treatment agent at 0 to 10° C.

12. Method of producing a clear textile treatment agent comprising:

adding to the agent a non-ionic surfactant with an HLB value of from 10.5 to 15 and a cloud temperature of at least 50° C., the agent further comprising a biocidal compound used in an amount of 0.1 wt. % to 2.5 wt. % based on total weight of the agent, wherein the biocidal compound is a quaternary ammonium compound chosen from dialkyldimethylammonium halides, and a perfume composition, wherein the dialkyldimethylammonium halide is selected from the group consisting of di-n-decyldimethylammonium chloride, didecyldimethylammonium bromide and dioctyldimethylammonium chloride, wherein the ratio of non-ionic surfactant to perfume composition is greater than or equal to 5:1.

* * * * *